US005555080A

United States Patent [19]

Elich et al.

[11] Patent Number: 5,555,080

[45] Date of Patent: Sep. 10, 1996

[54] SLIDE COVER FOR MARKING PARTICLE CARTRIDGE

[75] Inventors: Terry R. Elich, Pittsford; Thomas S. Wicks, Penfield, both of N.Y.

[73] Assignee: Eastman Kodak Company, Rochester, N.Y.

[21] Appl. No.: 569,388

[22] Filed: Dec. 8, 1995

[51] Int. Cl.[6] ..... G03G 15/08

[52] U.S. Cl. ..... 355/260; 222/DIG. 1

[58] Field of Search ..... 355/260; 414/411; 222/160, DIG. 1, 325; 220/350, 359; 141/364, 89; 206/816

[56] References Cited

U.S. PATENT DOCUMENTS

| | | | |
|---|---|---|---|
| 3,618,826 | 11/1971 | Kangas | 222/DIG. 1 |
| 4,062,385 | 12/1977 | Katusha et al. | 141/089 |
| 5,175,588 | 12/1992 | Katagata | 355/260 |
| 5,294,963 | 3/1994 | Nakano et al. | 355/260 |
| 5,335,831 | 8/1994 | Foster | 222/325 |

FOREIGN PATENT DOCUMENTS 2-115876 4/1990 Japan .

*Primary Examiner*—Joan Pendegrass
*Assistant Examiner*—Quana Grainger
*Attorney, Agent, or Firm*—Lawrence P. Kessler

[57] ABSTRACT

A marking particle cartridge including a container defining a marking particle storage chamber and an opening communicating with such chamber through which marking particles may pass, a removable tear strip attached to the container to cover the opening and enable the opening to be selectively uncovered, and a slide cover slidably attached to the container for movement between a first position sealing the opening of the container and a second position remote from the first position where the opening of the container is uncovered. The slide cover includes a substantially planar member and a plurality of ribs on the planar member. At least a portion of the ribs are positioned to lie in a direction at an angle to the direction of sliding movement of the slide cover between the first and second positions, such that the ribs trap and capture residual marking particles.

12 Claims, 4 Drawing Sheets

SLIDE COVER FOR MARKING PARTICLE CARTRIDGE

BACKGROUND OF THE INVENTION

The present invention relates in general to cartridges for replenishing marking particles in a reproduction apparatus, and more particularly to a molded slide cover for sealing a marking particle replenishment cartridge.

In certain typical commercial reproduction apparatus, such as copier/duplicator, printers, or the like, a latent image charge pattern is formed on a uniformly charged dielectric member. Pigmented marking particles are attracted to the latent charge pattern to develop such image on the dielectric member. A reviver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transposed away from the dielectric member to a fuser assembly at a downstream location. At the fuser assembly, the image is fixed to the receiver member by heat and/or pressure to form a permanent reproduction on such receiver member.

the pigmented marking particles, used to develop the latent image charge patterns, must periodically be replenished to ensure full and complete development of the latent image charge patterns. Due to the fine nature of the marking particles, such material has presented considerable difficulty in handling. That is, the fine particulate material easily becomes airborne and scatters into the environment surrounding the reproduction apparatus. Further, because the fine particulate material exhibits a distinct pigmentation (usually black), the material will contaminate everything it contacts, and make everything it contacts appear dirty.

An apparatus for handling marking particles for replenishment of reproduction apparatus in a way so as to avoid contamination is shown in US Pat. No. 4,062,385 (issued Dec. 12, 1977, in the name of Katusha et al). A marking particle cartridge has a housing or container which defines a chamber for storing the marking particles. A tear strip, located on the housing, has a surface potion subject to contact by the marking particle particles inside the chamber and is separable from the housing to allow the marking particles to empty through an opening in the container. A cover member of the marking particle cartridge engages the housing to cover the opening after the chamber is emptied of the marking particles. The cover includes a wiper, such as a resiliently compressible pad, for wiping any marking particles from the surface portion of the tear strip as the tear strip is separated from the housing. As the marking particles are emptied from the chamber, the housing is seated on a marking particle receiving receptacle in the electrophotographic apparatus. The housing, and the cover with the wiper, are supported by the receptacle in relative fixed positions. This enables the surface of the tear strip carrying marking particles to move in contact with the wiper as the tear strip is separated from the housing. With this arrangement, the surface of the tear strip is wiped clean of any marking particles before it can be touched by an operator. Besides serving as a wiper, the compressible pad positively seals the exit opening (after the tear strip is removed) when the cover is re-engaged with the housing. The compressible pad, while generally effective as a seal for the fine marking particles, represents an extra element of structure for the marking particle handling cartridge of the noted patent, and as such adds cost and assembly time to the manufacture thereof.

SUMMARY OF THE INVENTION

In view of the foregoing discussion, this invention is directed to a marking particle cartridge including a container defining a marking particle storage chamber and an opening communicating with such chamber through which marking particles may pass, a removable tear strip attached to the container to cover the opening and enable the opening to be selectively uncovered, and a slide cover slidably attached to the container for movement between a first position sealing the opening of the container and a second position remote from the first position where the opening of the container is uncovered. The slide cover includes a substantially planar member and a plurality of ribs on the planar member. At least a portion of the ribs are positioned to lie in a direction at an angle to the direction of sliding movement of the slide cover between the first and second positions, such that the ribs trap and capture residual marking particles.

The invention, and its objects and advantages, will become more apparent in the detailed description of the preferred embodiments presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
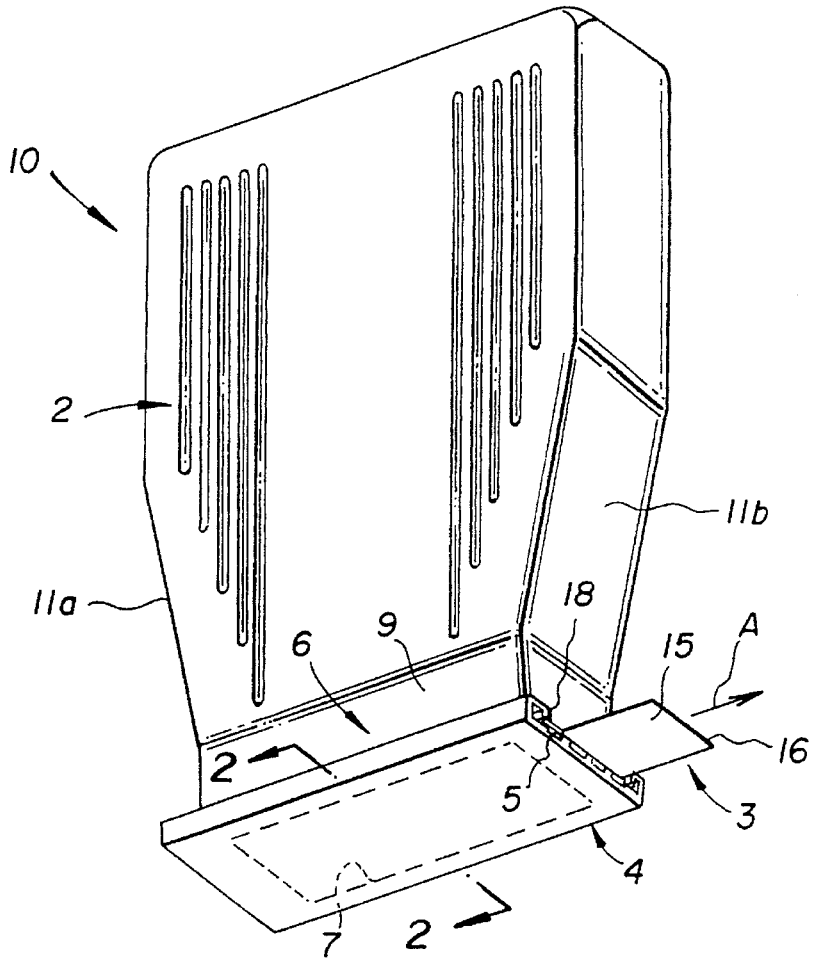
FIG. 1 is a view, in perspective, of the marking particle cartridge, including the slide cover, according to this invention, for the cartridge.
Figure 2:
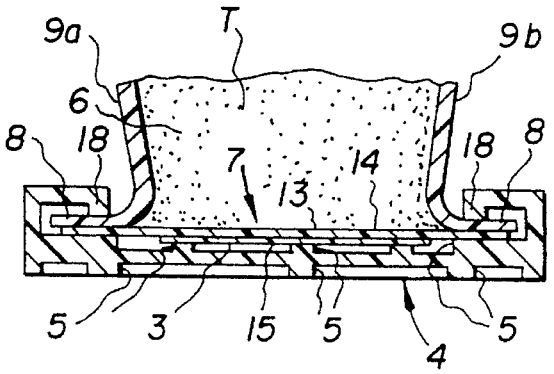
FIG. 2 is a front elevation view of a portion of the is marking particle cartridge and slide cover, in cross-section and on an enlarged scale, as viewed along the line 2—2 in FIG. 1.
Figure 3:
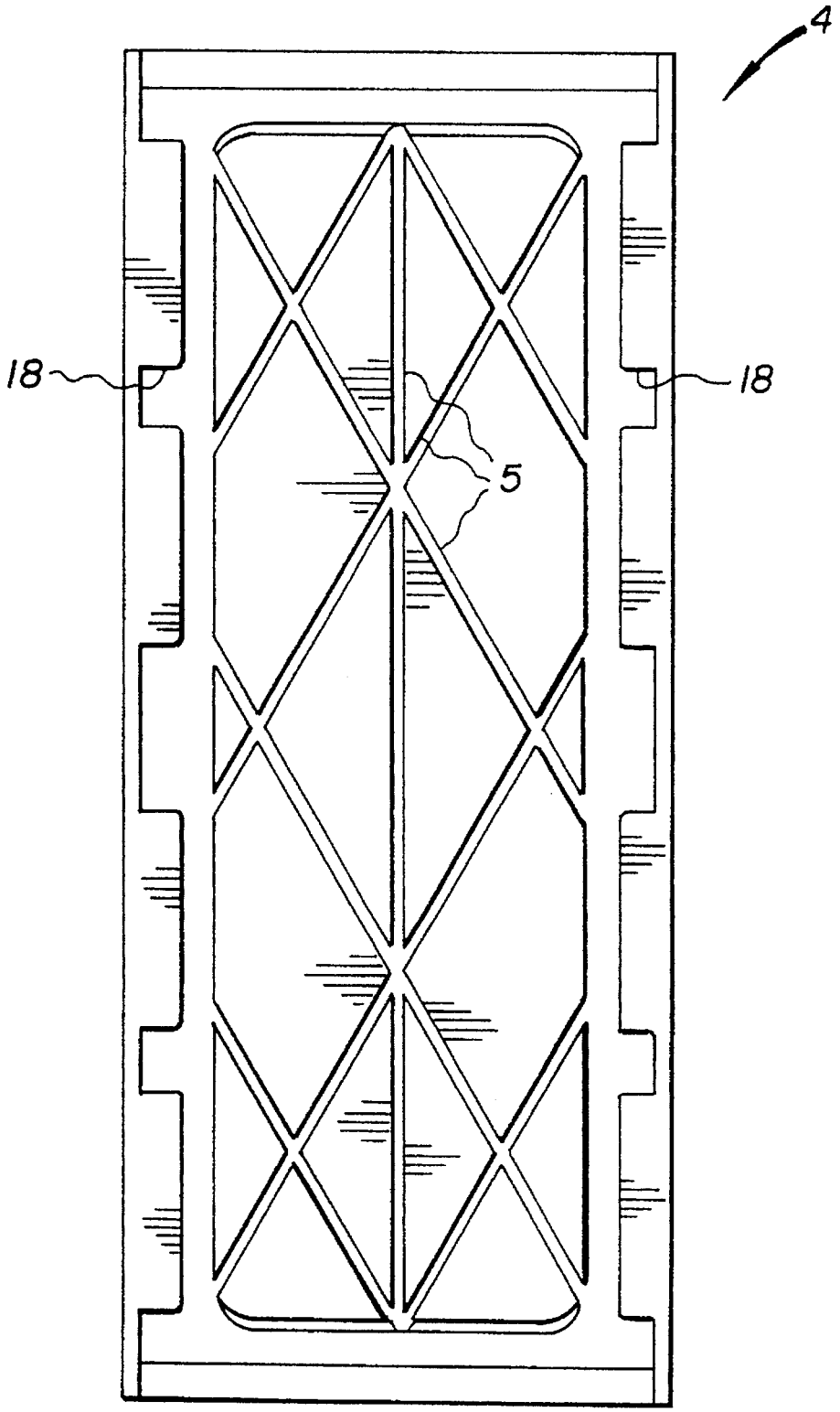
FIG. 3 is a top plan view of the marking particle cartridge slide cover, according to this invention.

Referring now to the accompanying drawings, and in particular to FIGS. 1, 2, and 3, there is shown a marking particle storage cartridge generally designated by the reference numeral 10. In substance, such cartridge 10 is an assembly similar to that shown and fully described in the aforementioned US Pat. No. 4,062,385, but containing only three pieces; a hollow container or housing 2 defining a chamber in which is contained marking particles T; a tear strip 3 which, before its removal from the housing, prevents the marking particles T from leaking out of the housing 2; and a slide cover 4 engageable with the housing 2.

The housing 2 is shown as a blow molded plastic container made, for example, from polyethylene, polypropylene, polyallomer, or a copolymer of such resins. A neck portion 6 of the housing 2 terminates in a rectangular shaped open end 7, peripherally about which is disposed a flat flange member 8. The flange member 8 is integrally formed with the housing 2, and projects from the housing generally in the plane occupied by the open end 7 (best shown in FIGS. 2, 5 and 6). At the neck portion 6, the housing 2 includes two oppositely spaced wall sections 9*a* and 9*b* which converge toward the open end 7. Above is the neck portion 6, the housing 2 includes two oppositely spaced wall sections 11*a* and 11*b* (substantially perpendicular to the wall sections 9*a*, 9*b*) which also converge toward the neck portion 6. These converging wall sections 9*a*, 9*b*, 11*a*, and 11*b* facilitate gravity flow of the marking particles T from the housing 2, through its open end 7.

The tear strip 3 is constructed, for example, of spun bonded polyethylene film coated with a hot melt adhesive. As shown in FIG. 2, the tear strip 3 includes a sealing piece or member 13 which is secured to the housing flange 8, over the open end 7. By this arrangement, the tear strip 3 serves to seal the open end 7, preventing the marking particles T from leaking out of the housing 2. As is evident, a surface 14 of the sealing piece 13 is subject to contact by the marking particles T inside the housing 2. In addition to the sealing piece 13, the tear strip 3 includes a pull tab piece of member 15, integrally formed with the sealing piece and folded, or doubled back, over the sealing piece. The pull tab piece 15 terminates in a free leading end 16 which extends beyond the housing 2 and which, when pulled in the direction generally indicated by the arrow A in FIGS. 1 and 5, separates the sealing piece 13 from the flange member 8. This, in effect, opens the housing 2 and enables gravity flow of the marking particles T from the housing, through the open end 7.

The slide cover 4, according to this invention, is constructed of an injection molded high density polyethylene material. As shown in FIGS. 2 and 3, the slide cover 4 has two oppositely spaced pinch rails 18 which are engageable with the flange member 8, at the neck portion 6 of the housing 2. Engagement of the two pinch rails 18 with the flange member 8, as depicted in FIG. 1, locates the slide cover 4 completely over the open end 7. By this arrangement, the slide cover 4 maintains the pull tab piece 15 of the tear strip 3 folded over its sealing piece 13 and protects the tear strip from any possible puncture during shipping, for example. The sealing piece 13 is peeled off the flange member 8, to open the housing 2, after the slide cover 4 is disengaged from the flange member. The slide cover 4 is disengaged from the flange member 8 by moving the slide cover, with respect to the remainder of the marking particle cartridge 10, in the direction generally indicated by the arrow A. After the tear strip 3 is removed from the housing 2 by peeling the sealing piece 13 off the flange member 8 and the marking particles T are drained form the housing, the slide cover 4 is slidable for re-engagement with the flange member, over the open end 7, to serve, for example, as a dust cover for the empty container.

The inside planar surface of the slide cover 4, between the pinch rails 18, facing the sealing piece 13, has a plurality of raised ribs 5 (see FIGS. 2 and 3). The raised ribs 5 are formed in the molding process during manufacture of the slide cover 4. The location of the ribs 5 is selected so that the ribs are in a predetermined pattern set at an angle to the direction of motion of the slide cover 4 when the slide cover is moved relative to the marking particle cartridge 10 (i.e., in the direction indicated by the arrow A). The predetermined angled pattern for the ribs serves to enable the ribs to positively seal the open end 7 at the neck portion 6 of the housing 2, by occupying the space previously occupied by the sealing piece 13 of the tear strip 3, when the slide cover 4 is re-engaged with flange member 8 of the empty cartridge 10. Such pattern is selected to additionally add to the strength of the slide cover 4, and markedly reduce the amount of material required to make the cover. Moreover, the angle of the ribs 5 enables the ribs to effectively trap and capture marking particles from the surface of the sealing piece, previously in engagement with the marking particles T, as the sealing piece is removed. Of course, to further improve the strength of the slide cover 4, an additional set of ribs can be formed on the opposite side of the aforementioned planar surface. The additional ribs may be oriented, relative to the direction of motion of the slide cover, in alignment therewith, at an angle thereto, or in some combination thereof.

Figure 4:
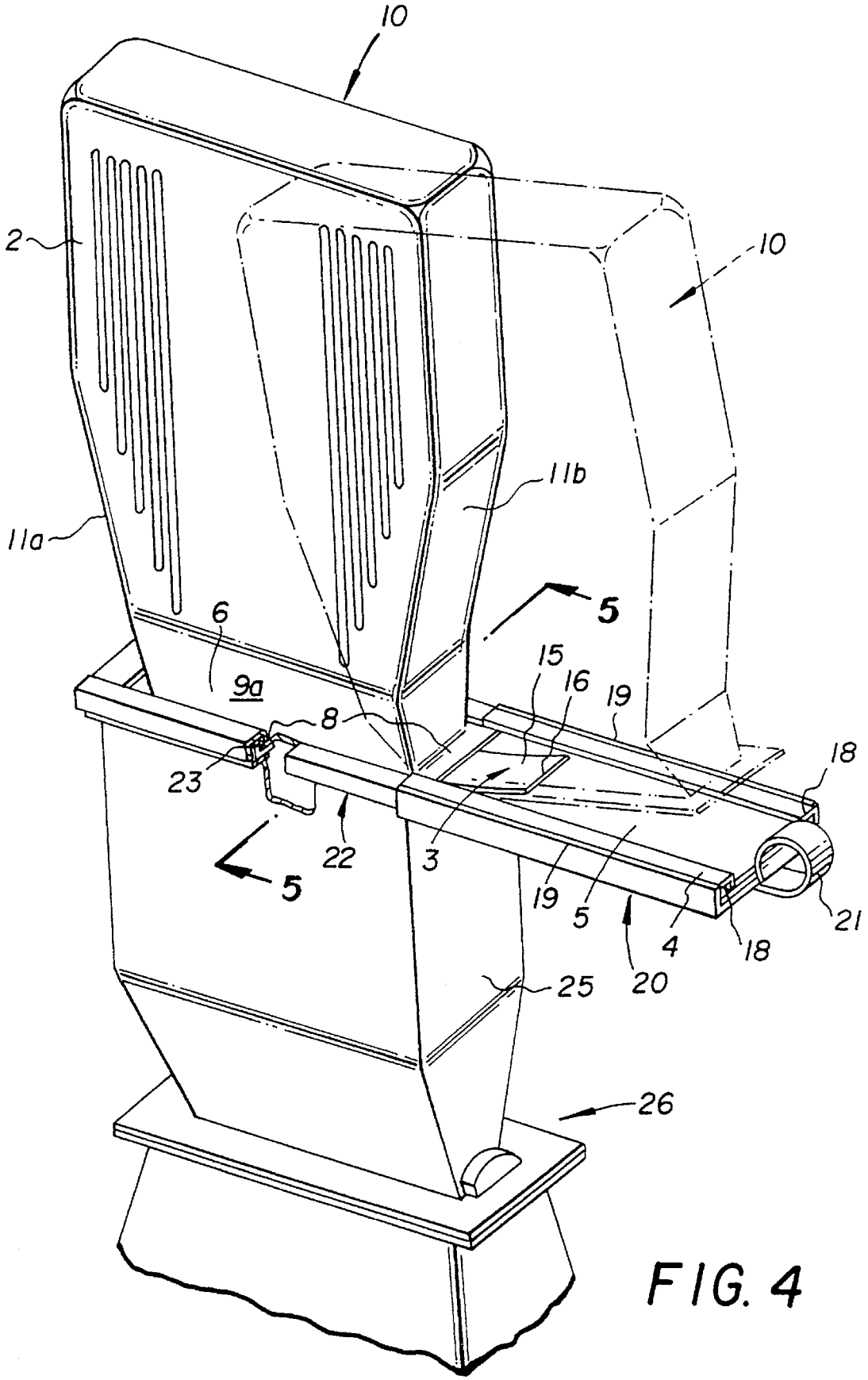
FIG. 4 is a view, in perspective, of the marking particle cartridge and slide cover, according to this invention, and a reproduction apparatus receptacle for such cartridge, schematically illustrating the manner in which the marking particle cartridge is operatively positioned on the receptacle.

FIG. 4 illustrates the marking particle cartridge 10 in a first position (depicting the marking particle cartridge in phantom lines), and a second position (depicting the marking particle cartridge in solid lines). In the first position, the marking particle cartridge 10 is ready for insertion into a marking particle dispensing mechanism 26 of a reproduction apparatus (such as, for example, an electrophotographic copier, not shown), and in the second position, the marking particle cartridge is operatively associated with such dispensing mechanism. The dispensing mechanism 26 is disposed in the reproduction apparatus in any well known manner to communicate with a development station thereof. The function of the mechanism 26 then is to dispense metered quantities of the marking particles (received from the marking particle cartridge 10) to the development station to be used for image development, in a suitable manner well known in the art of electrophotographic copiers.

Figure 5:
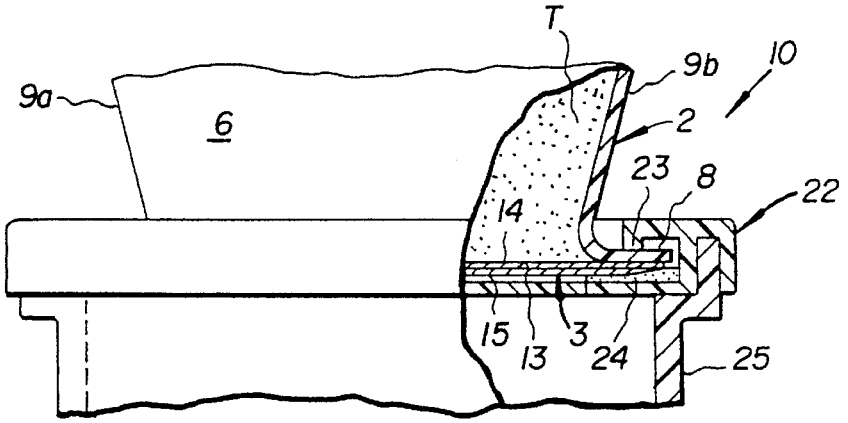
FIG. 5 is a front elevation view of a portion of the marking particle cartridge and slide cover and the reproduction apparatus receptacle, in cross-section and on enlarged scale, as viewed along the line 5—5 in FIG. 4.

The phantom line depiction of the marking particle cartridge 10, for the purpose of facilitating clarity and understanding of the invention, represents the cartridge without the slide cover 4. In use, the marking particle cartridge 10 is located in the first position as shown in FIG. 4, and then is pressed downwardly onto a loading fixture 20 of the dispensing mechanism 26. The loading fixture 20 locates the slide cover 4 snugly between two oppositely spaced guide mils 19 of the loading fixture. An end spring 21, on the loading fixture 20, facilitates the desired positioning of the slide cover 4 between the two guide rails 19. The two guide mils 19 of the loading fixture 20 securely hold the slide cover 4 in place. This allows the housing 2, containing the marking particles T, to be separated from the slide cover 4 by moving the housing, generally to the left as viewed in FIG. 4, from the loading fixture 20 to a contiguously located receiving fixture 22 of the dispensing mechanism 26. Two oppositely spaced pinch rails 23 of the receiving fixture 22 engage the housing flange 8, as shown in FIGS. 4 and 5. Inside the receiving fixture 22, several resiliently compressible pads 24 hold the housing flange 8 in abutment with the two pinch rails 23.

When engaged with the receiving fixture 22 in the manner described above, and as shown in FIG. 4, the housing 2 of the marking particle cartridge 10 has its open end 7 in communication with a hopper 25 of the dispensing mechanism 26. As the sealing piece 13 of the tear strip 3 is peeled off the flange member 8 of the housing 2, the open end 7 is uncovered. The marking particles T inside the housing 2 can then drain freely through the open end 7 into the hopper 25 (see FIG. 6).

Figure 6:
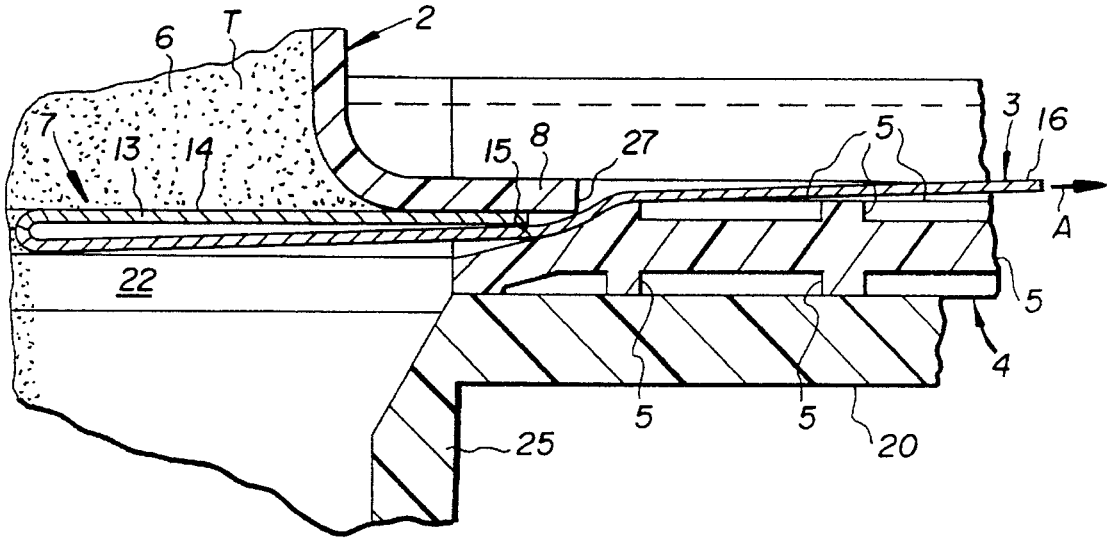
FIG. 6 a side elevational view of a portion of the marking particle cartridge and slide cover and the reproduction apparatus receptacle, in cross-section and on an enlarged scale.

As can be seen in FIG. 6, as the leading end 16 of the tear strip 3 is pulled by an operator in the direction generally indicated by the arrow A, the sealing piece 13 of the tear strip is peeled off the flange member 8 of the housing 2. An end 27 of the flange member 8 serves to first hold the pull tab piece 15 of the tear strip 3 in wiping contact with the ribs 5 (on the slide cover 4) and then holds the surface 14 of the sealing piece 13 in wiping contact with the ribs. Accordingly, as the tear strip 3 is separated from the flange member 8, the surface 14 (which is the single portion of the tear strip subject to contact by the marking particles T) is wiped clean of any residual marking particles by the ribs 5 and such residual marking particles are trapped and captured thereby. This action is accomplished before any portion of surface 14 of the tear strip 3 can be touched by the operator.

After the tear strip 3 is removed from the housing 2 and the marking particles T are drained from the housing into the hopper 25, the slide cover 4 may be re-engaged with the flange member 8 by sliding the housing, generally to the right as viewed in FIG. 4, from the receiving fixture 22 to the loading fixture 20. Then, the marking particle cartridge 10, with its slide cover 4 serving as a dust cover for the empty container, can be removed from the loading fixture and discarded.

The invention has been described in detail with particular reference to preferred embodiments thereof, but it will be understood that variations and modifications can be effected within the spirit and scope of the invention as set forth in the claims.

What is claimed is:

1. A marking particle cartridge including a container defining a marking particle storage chamber and an opening communicating with such chamber through which marking particles may pass, a removable tear strip attached to said container to cover said opening and enable said opening to be selectively uncovered, and a slide cover slidably attached to said container for movement between a first position sealing said opening of said container and a second position remote from said first position where said opening of said container is uncovered, said slide cover comprising:

a substantially planar member; and a plurality of ribs on said planar member, said ribs being positioned such that said ribs trap and capture residual marking particles.

2. The slide cover according to claim 1 wherein said ribs are positioned to lie in a direction at an angle to the direction of sliding movement of said slide cover between said first and second positions.

3. The slide cover according to claim 2 wherein said ribs extend in a substantial upstanding direction from said planar member.

4. The slide cover according to claim 3 wherein said ribs are oriented to face the surface of said tear strip exposed to marking particles through said opening in said container, when said tear strip is removed from covering said opening.

5. The slide cover according to claim 1 wherein said ribs extend outwardly from both facial surfaces of said planar member, such that said slide member is substantially strengthened.

6. The slide cover according to claim 5 wherein said ribs extend respectively in substantial upstanding directions from said planar member and are positioned such that at least some of said ribs, oriented to face the surface of said tear strip exposed to marking particles through said opening in said container when said tear strip is removed from covering said opening, lie in a direction at an angle to the direction of sliding movement of said slide cover between said first and second positions.

7. A marking particle cartridge comprising:

a container defining a marking particle storage chamber and an opening communicating with such chamber through which marking particles may pass;

a tear strip removably attached to said container to cover said opening and enable said opening to be selectively uncovered; and a substantially planar slide cover attached to said container for slidable movement between a first position sealing said opening of said container and a second position remote from said first position where said opening of said container is uncovered, said slide cover including a plurality of ribs positioned to trap and capture residual marking particles.

8. The slide cover according to claim 7 wherein at least a portion of said ribs lie in a direction at an angle to the direction of sliding movement of said slide cover between said first and second positions.

9. The slide cover according to claim 8 wherein at least a portion of said ribs extend in a substantial upstanding direction from a first planar surface of said slide cover, oriented to face the surface of said tear strip exposed to marking particles through said opening in said container, when said tear strip is removed from covering said opening.

10. The slide cover according to claim 7 wherein at least a portion of said ribs extend outwardly from the planar surface opposite said first planar surface of said planar member, such that said slide member is substantially strengthened.

11. The slide cover according to claim 10 wherein at least a portion of said ribs extend in a substantial upstanding direction from a first planar surface of said slide cover, oriented to face the surface of said tear strip exposed to marking particles through said opening in said container when said tear strip is removed from covering said opening, lie in a direction at an angle to the direction of sliding movement of said slide cover between said first and second positions.

12. The slide cover according to claim 9 wherein said container includes a pair of opposed flanges along marginal edges of said container adjacent to said opening defined thereby, and said planar member includes a pair of opposed channels adapted to receive corresponding flanges to slidably associate said slide cover with said container.

* * * * *